US005125197A

United States Patent [19]

Fuchs

[11] Patent Number: 5,125,197

[45] Date of Patent: Jun. 30, 1992

[54] INTERIOR COVER FOR AN AIR CONDITIONER MOUNTED IN A WALL

[76] Inventor: Arthur E. Fuchs, 33 Frankie La., North Babylon, N.Y. 11703-3701

[21] Appl. No.: 705,112

[22] Filed: May 21, 1991

[51] Int. Cl.[5] ..... E06B 3/30

[52] U.S. Cl. ..... 52/202; 52/511; 62/262; 312/100

[58] Field of Search ..... 150/165; 62/262, 259.1; 312/100, 101; 160/238; 98/94.2; 52/511, 202, 208, 36, 403

[56] References Cited

U.S. PATENT DOCUMENTS

| | | | |
|---|---|---|---|
| 4,202,389 | 5/1980 | Ewald | 150/165 |
| 4,221,091 | 9/1980 | Ganse et al. | 52/202 |
| 4,325,229 | 4/1982 | DeZurik | 62/262 |
| 4,325,594 | 4/1982 | Lane et al. | 312/100 |
| 4,332,146 | 6/1982 | Groebel et al. | 98/94.2 X |
| 4,376,082 | 3/1983 | Heck | 312/100 X |
| 4,389,827 | 6/1983 | Van Valkenburg | 98/94.2 X |
| 4,426,120 | 1/1984 | Johnson et al. | 312/100 |
| 4,625,784 | 12/1986 | Boroson | 150/165 |
| 4,759,194 | 7/1988 | Shapiro | 62/262 |
| 4,788,805 | 12/1988 | Shaw | 52/202 |

*Primary Examiner*—David A. Scherbel
*Assistant Examiner*—Robert Canfield
*Attorney, Agent, or Firm*—Michael I. Kroll

[57] ABSTRACT

An improved interior cover is provided for an air conditioner having a cabinet and front grille, the cabinet is mounted in an aperture in a wall of a building. The improved interior cover consists of an enclosure member sized to fit over the front grille and front portion of the cabinet of the air conditioner. A mechanism is for removably securing the enclosure member to the front grille/front portion of the cabinet of the air conditioner, while another mechanism is for thermally sealing the enclosure member to a front surface of the wall of the building about the aperture so as to prevent cold air and wind infiltration to enter the building through the aperture.

12 Claims, 2 Drawing Sheets

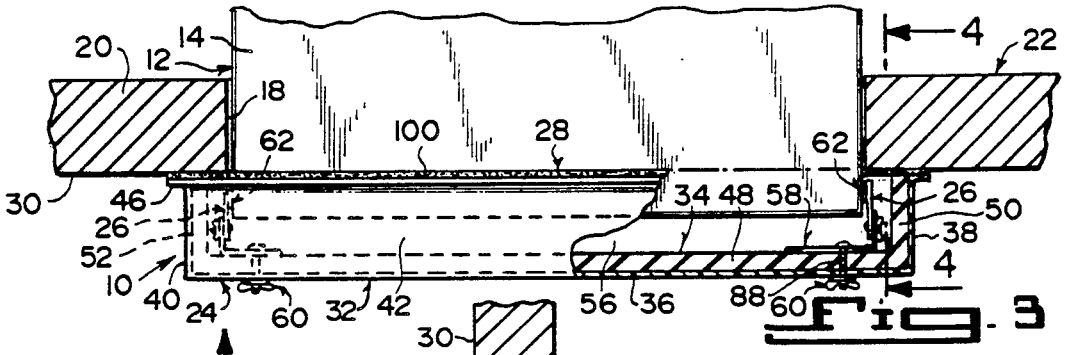
Fig. 3
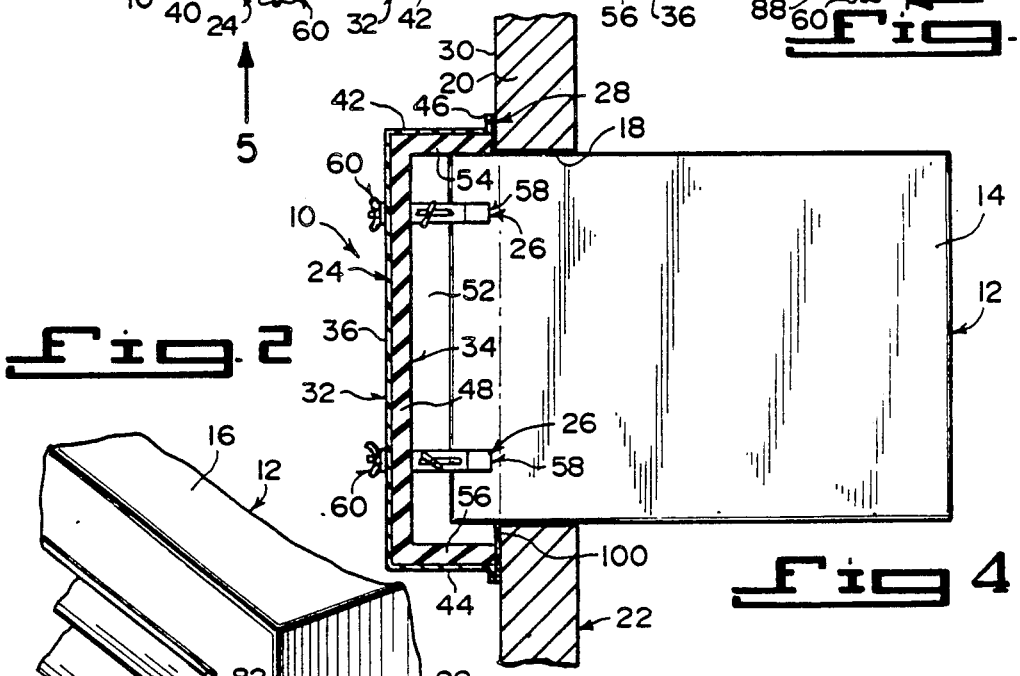
Fig. 2
Fig 4
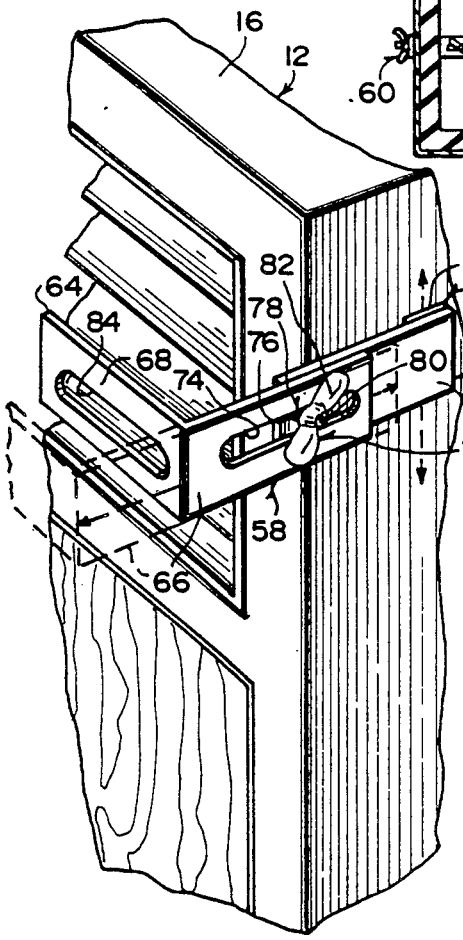
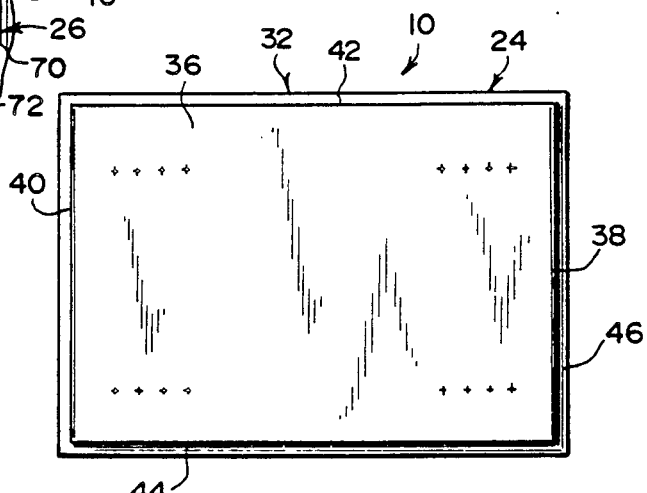
Fig 5

INTERIOR COVER FOR AN AIR CONDITIONER MOUNTED IN A WALL

BACKGROUND OF THE INVENTION

1. Field of the Invention

The instant invention relates generally to insulating devices and more specifically it relates to an improved interior cover for an air conditioner mounted in a wall.

2. Description of the Prior Art

Each year, at the end of the summer season, an owner of a wall mounted air conditioner is faced with the need to seal the air conditioner from winter weather conditions. This is usually done by wrapping the exterior of the cabinet of the air conditioner with a plastic sheet or by covering it with a commercially available plastic cover, open at the bottom, on the rear of the air conditioner cabinet. Neither method stops the infiltration of the cold air because insulation is not present. If the air conditioner is installed on any floor higher than the first floor, the covering operation involves a person hanging off an extension ladder and risking injury from a possible fall.

Numerous insulating devices have been provided in prior art that are adapted to conserve energy by enclosing openings, such as for doors, windows, air conditioners or the like in building structure. While these units may be suitable for the particular purpose to which they address, they would not be as suitable for the purposes of the present invention as heretofore described.

SUMMARY OF THE INVENTION

A primary object of the present invention is to provide an improved interior cover for an air conditioner mounted in a wall that will overcome the shortcomings of the prior art devices.

Another object is to provide an improved interior cover for an air conditioner mounted in a wall that is installed over the air conditioner from the inside of a building and will insulate the aperture within the wall for the air conditioner by employing a weather stripping seal thereabout.

An additional object is to provide an improved interior cover for an air conditioner mounted in a wall in which installation of the cover requires adjustment of the magnetic attachment brackets, whereby the enclosure can be pressed into positioned about the front of the air conditioner cabinet, sealing the aperture to prevent cold air and wind infiltration into the building.

A further object is to provide an improved interior cover for an air conditioner mounted in a wall that is simple and easy to use.

A still further object is to provide an improved interior cover for an air conditioner mounted in a wall that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 2 is an enlarged perspective detail view of one of the adjustable attachment brackets as indicated by arrow 2 in FIG. 1.

FIG. 3 is a top view with parts broken away and in section showing the instant invention installed.

FIG. 4 is a side cross sectional view taken along line 4—4 in FIG. 3.

FIG. 5 is a front view of just the enclosure member taken in direction of arrow 5 in FIG. 3.

DETAILED DESCRIPTION OF THE PREFERRED EMBODIMENTS

Figure 1:
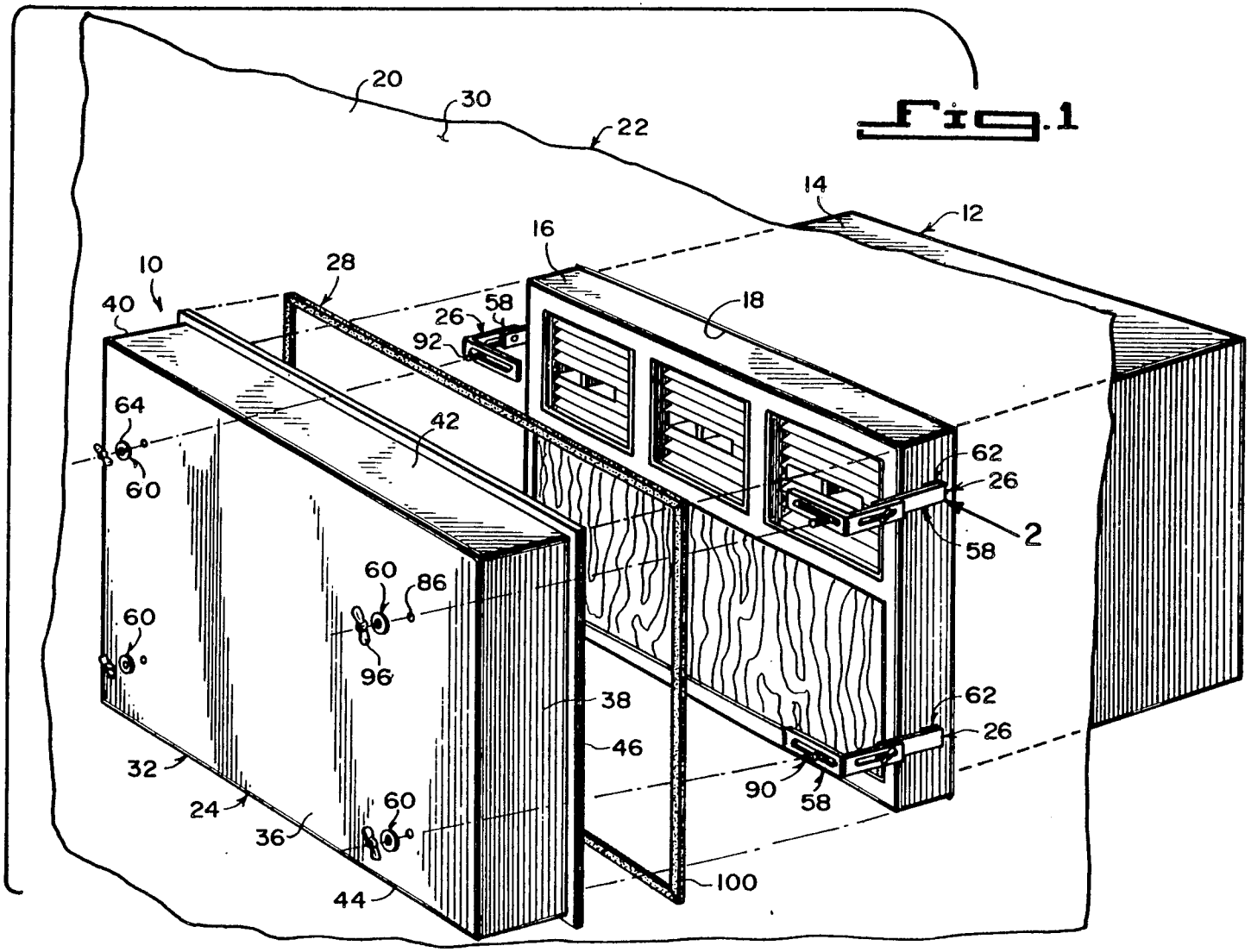
FIG. 1 is an exploded perspective view of the instant invention ready to be installed on the front of an air conditioner in a wall.

Turning now descriptively to the drawings, in which similar reference characters denote similar elements throughout the several views, the Figures illustrate an improved interior cover 10 for an air conditioner 12 having a cabinet 14 and a front grille 16. The cabinet 14 is mounted in an aperture 18 in a wall 20 of a building 22. The improved interior cover 10 consists of an enclosure member 24 sized to fit over the front grille 16 and the front portion of the cabinet 14 of the air conditioner 12. A mechanism 26 is for removably securing the enclosure member 24 to the front grille 16/front portion of the cabinet 14 of the air conditioner 12. Another mechanism 28 is for thermally sealing the enclosure member 24 to a front surface 30 of the wall 20 of the building 22 about the aperture 18 so as to prevent cold air and wind infiltration to enter the building 22 through the aperture 18.

The enclosure member 24 includes an outer thin rigid protection shell 32 and an inner tick rigid insulation shell 34 affixed to outer shell 22. The outer shell 32 is fabricated out of a molded plastic material and includes a front panel 36 larger in size than the aperture 18 in the wall 20 of the building 22. A right wall 38 is formed integrally with and extends inwardly from the right side of the front panel 36. A left wall 40 is formed integrally with and extends inwardly from the left side of the front panel 36. A top wall 42 is formed integrally with and extends inwardly from the top side of the front panel 36. A bottom wall 44 is formed integrally with and extends inwardly from the bottom side of the front panel 36. Flange 46 is formed integrally with and extends outwardly from the right wall 38, the left wall 40, the top wall 42 and the bottom wall 44 in a plane substantially parallel to the front panel 36.

The inner shell 34 is fabricated out of a styrofoam material and includes a front plate 48. A right partition 50 is formed integrally with and extends inwardly from the right side of the front panel 48. A left partition 52 is formed integrally with and extends inwardly form the left side of the front plate 48. A top partition 54 is formed integrally with and extends inwardly from the top side of the front plate 48. A bottom partition 56 is formed integrally with and extends inwardly from the bottom side of the front plate 48.

The removably securing mechanism 26 includes a plurality of adjustable brackets 58. A mechanism 60 is for mounting one end of each of the adjustable brackets 58 to the enclosure member 24 proximate the right and left sides thereof. Another mechanism 62 is for removably attaching an opposite end of each of the adjustable brackets 58 to the side of the front grille 16/front portion of the cabinet 14 of the air conditioner 12.

Each adjustable bracket 58 includes an L-shaped member 64 having a first arm 66 and a second arm 68, a straight member 70 and a mechanism 72 for adjustably affixing the straight member 70 to the first arm 66 of the L-shaped member 64.

The adjustably affixing mechanism 72 includes the first arm 66 of said L-shaped member having a first elongated slot 74 therein, the straight member 70 has a hole 76 extending through a first end thereof. A bolt 78 has a threaded shank 80 which extends through the hole 76 in the straight member 70 and through the first elongated slot 74 in the first arm 66 of the L-shaped member 64. A wing nut 82 is threadable onto a distal end of the threaded shank 80 of the bolt 78 so that the straight member 70 can be adjustably positioned and retained to the first arm 66 of the L-shaped member 64 of the adjustable bracket 58.

The mounting mechanism 60 includes the second arm 68 of the L-shaped member 64 having a second elongated slot 84 therein. The front panel 36 of the outer shell 32 has a hole 86 extending therethrough. The front plate 48 of the inner shell 34 has a hole 88 extending therethrough in alignment with the hole 86 in the front panel 36. A bolt 90 has a threaded shank 92 which extends through the second elongated slot 84 in the second arm 68 of the L-shaped member 64 of the adjustable bracket 58, through the hole 88 in the front plate 48 of the inner shell 34 and through the hole 86 in the front panel 36 of the outer shell 32 of the enclosure member 24. A washer 94 fits over a distal end of the threaded shank 92 of the bolt 90. A wing nut 96 is threadable onto the distal end of the threaded shank 92 of the bolt 90 so that the second arm 68 of the L-shaped member 64 can be adjustably positioned and retained to the enclosure member 24.

The removably attaching mechanism 62 includes a magnet 98 connected to the inner side of a second end of the straight member 70 of the adjustable bracket 58. The magnet 98 can be attached to the side of the front grille 16/front portion of the cabinet 14 of the air conditioner 12 if the front grille 16 and the cabinet 14 of the air conditioner 12 are fabricated out of magnetic material.

The L-shaped member 64 and the straight member 70 of each adjustable bracket 58 is fabricated out of a non-magnetic material, such as plastic and the like.

The thermally sealing mechanism 28 is a strip of resilient, compressible weather stripping material 100 secured to the inner surface of e flange 46 around the entire periphery of the flange 46 so as to bear against the front surface 30 of the wall 20 of the building 22.

LIST OF REFERENCE NUMBERS

10: improved interior cover
12: air conditioner
14: cabinet
16: front grille
18: aperture
20: wall
22: building
24: enclosure member
26: removably securing mechanism
28: thermally sealing mechanism
30: front surface 30 of 20
32: outer thin rigid protection shell
34: inner thick rigid insulation shell
36: front panel of 32
38: right wall of 32
40: left wall of 32
42: top wall of 32
44: bottom wall of 32
46: flange of 32
48: front plate of 34
50: right partition of 34
52: left partition of 34
54: top partition of 34
56: bottom partition of 34
58: adjustable bracket
60: mounting mechanism
62: removably attaching mechanism
64: L-shaped member of 58
66: first arm of 64
68: second arm of 64
70: straight member of 58
72: adjustably affixing mechanism
74: first elongated slot
76: hole in 70
78: bolt
80: threaded shank of 78
82: wing nut
84: second elongated slot in 68
86: hole in 36
88: hole in 48
90: bolt
92: threaded shank of 90
94: washer
96: wing nut
98: magnet
100: strip of weather stripping material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applicaticns without omitting features that, from the standpoint of prior art, fairly constitute essential characteristics of the generic or specific aspects of this invention.

What is claimed is new and desired to be protected by Letters Patent is set forth in the appended claims:

1. An improved interior cover for an air conditioner having a cabinet and front grille, the cabinet being mounted in an aperture in a wall of a building, said improved interior cover comprising:

a) an enclosure member sized to fit over the front grille and a front portion of the cabinet of the air conditioner;

b) means for removably securing said enclosure member to the front grille and the front portion of the cabinet of the air conditioner; and c) enclosure member to the wall of the building about the aperture so as to prevent cold air and wind infiltration to enter the building through the aperture; wherein said means for removably securing said enclosure member includes: d) a plurality of adjustable brackets; e) means for mounting one end of each of said adjustable brackets to said enclosure member proximate the right and left sides thereof; and f) means for removably attaching an opposite end of each of said adjustable brackets to the side of the front of the grille and to the front portion of the cabinet of the air conditioner.

2. An improved interior cover as recited in claim 1, wherein said enclosure member includes:

a) an outer thin rigid protection shell; and b) an inner tick rigid insulation shell affixed to said outer shell.

3. An improved interior cover as recited in claim 2, wherein said outer shell is fabricated out of a molded plastic material.

4. An improved interior cover as recited in claim 3, wherein said outer shell further includes:

a) a front panel larger in size than the aperture in the wall of the building;

b) a right wall, a left wall, a top wall and a bottom wall all formed integrally with and extending from the front panel towards said wall of a building; c) a flange formed integrally with and extending outwardly from said right, left, top, and bottom walls in a plane substantially parallel to said front panel.

c) a left wall formed integrally with and extending inwardly from the left side of said front panel;

d) a flange formed integrally with and extending outwardly from said right wall, said left wall, said top wall and said bottom wall in a plane substantially parallel to said front panel.

5. An improved interior cover as recited in claim 4, wherein said inner shell is fabricated out of a styrofoam material.

6. An improved interior cover as recited in claim 5, wherein said inner shell further includes:

a) a front plate;

b) a right partition formed integrally with and extending inwardly from the right side of said front plate;

c) a left partition formed integrally with and extending inwardly from the left side of said front plate;

d) a top partition formed integrally with and extending inwardly from the top side of said front plate; and e) a bottom partition formed integrally with and extending inwardly from the bottom side of said front plate.

7. An improved interior cover as recited in claim 1, wherein each said adjustable bracket includes:

a) an L-shaped member having a first arm and a second arm;

b) a straight member; and c) means for adjustably affixing said straight member to said first arm of said L-shaped member.

8. An improved interior cover as recited in claim 7, wherein said adjustably affixing means includes:

a) the first arm of said L-shaped member having a first elongated slot therein;

b) said straight member having a hole extending through a first end thereof;

c) a bolt having a threaded shank which extends through the hole in said straight member and through the first elongated slot in the first arm of said L-shaped member; and d) a wing nut threadable onto a distal end of the threaded shank of said bolt so that said straight member can be adjustably positioned and retained to the first arm of said L-shaped member of said adjustable bracket.

9. An improved interior cover as recited in claim 8, wherein said means for mounting includes:

a) the second arm of said L-shaped member having a second elongated slot therein;

b) said front panel of said outer shell having a hole extending therethrough;

c) said front plate of said inner shell having a hole extending therethrough in alignment with the hole in said front panel;

d) a bolt having a threaded shank which extends through the second elongated slot in the second arm of said L-shaped member of said adjustable bracket, through the hole in said front plate of said inner shell and through the hole in said front panel of said outer shell of said enclosure member;

e) a washer to fit over a distal end of the threaded shank of said bolt; and f) a wing nut threadable onto the distal end of the threaded shank of said bolt so that the second arm of said L-shaped member can be adjustably positioned and retained to said enclosure member.

10. An improved interior cover as recited in claim 9, wherein said means for removably attaching includes a magnet connected to the inner side of a second end of said straight member of said adjustable bracket so that said magnet can be attached to the side of the front grille/front portion of the cabinet of the air conditioner if the front grille and the cabinet of the air conditioner are fabricated out of magnetic material.

11. An improved interior cover as recited in claim 10, wherein said L-shaped member and said straight member of each said adjustable bracket is fabricated out of a non-magnetic material, such as plastic or the like.

12. An improved interior cover as recited in claim 11, wherein said thermally sealing means is a strip of resilient, compressible weather stripping material secured to an inner surface of said flange around the entire periphery of said flange so as to bear against a front surface of the wall of the building.

* * * * *